US009175884B2

(12) United States Patent
Olson

(10) Patent No.: US 9,175,884 B2
(45) Date of Patent: Nov. 3, 2015

(54) SYSTEM, APPARATUS AND METHOD FOR PULSE TUBE CRYOCOOLER

(71) Applicant: Lockheed Martin Corporation, Bethesda, MD (US)

(72) Inventor: Jefferey R. Olson, San Mateo, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 309 days.

(21) Appl. No.: 13/938,529

(22) Filed: Jul. 10, 2013

(65) Prior Publication Data

US 2015/0013348 A1 Jan. 15, 2015

(51) Int. Cl.

| | |
|---|---|
| ***F25B 9/00*** | (2006.01) |
| ***F25B 9/14*** | (2006.01) |
| *F25B 9/10* | (2006.01) |

(52) U.S. Cl.

CPC . *F25B 9/145* (2013.01); *F25B 9/10* (2013.01); *F25B 2309/1407* (2013.01); *F25B 2309/1412* (2013.01); *F25B 2309/1414* (2013.01); *F25B 2309/1415* (2013.01); *F25B 2309/1419* (2013.01)

(58) Field of Classification Search

CPC ..... F25B 9/14; F25B 9/145; F25B 2309/02; F25B 2309/1412; F25B 2309/1415; F25B 2309/1419

USPC ..... 62/6

See application file for complete search history.

(56) References Cited

U.S. PATENT DOCUMENTS

| | | | | |
|---|---|---|---|---|
| 6,865,894 | B1 | 3/2005 | Olson | |
| 7,363,767 | B2 | 4/2008 | Wang | |
| 2005/0022540 | A1* | 2/2005 | Kim et al. | 62/6 |
| 2005/0198970 | A1* | 9/2005 | Acharya et al. | 62/6 |
| 2013/0283823 | A1* | 10/2013 | Yuan et al. | 62/6 |

FOREIGN PATENT DOCUMENTS

WO 2008/125139 A1 10/2008

OTHER PUBLICATIONS

S.W.K. Yuan et al., A Non-tube Inertance Device for Pulse Tube Cryocoolers, IEEE/CSC 7 ESAS European Superconductivity News Forum (ESNF), No. 10, Oct. 2009, pp. 143-148.

S. Sobol et al., A Study of a Miniature In-Line Pulse Tube Cryocooler, International Cryocooler Conference, Inc., 2011, pp. 87-95.

Ray Radebaugh, Pulse Tube Cryocoolers for Cooling Infrared Sensors, Proceedings of SPIE, The International Society for Optical Engineering, Infrared Technology and Applications XXVI, vol. 4130, 2000, pp. 363-379.

J.L. Hall et al., A Contaminant Ice Visualization Experiment in a Glass Pulse Tube, Proceedings of the 1999 Cryogenic Engineering Conference, Jul. 1999, pp. 1-8.

* cited by examiner

*Primary Examiner* — Melvin Jones

(74) *Attorney, Agent, or Firm* — Terry M. Sanks, Esq.; Beusse Wolter Sanks & Maire, PLLC

(57) ABSTRACT

A pulse tube cryocooler (PTC) includes an etched glass substrate bonded to a glass plate and defining one or multiple stages or layers. The PTC includes a plurality of channels etched into a surface of the substrate to define a heat exchanger, a pulse tube, a cold heat exchanger or cold head, a regenerator and an aftercooler. The bonded substrate and plate encloses the plurality of channels to form capillaries operable for conducting and distributing fluid. The pulse tube is disposed between the cold head and the heat exchanger and the regenerator is disposed between the cold head and the aftercooler. The heat exchanger is connected to a valve or inertance tube which, in turn, is connectable to a buffer tank or reservoir that contains fluid. The aftercooler is connectable to an external compressor operable for oscillating movement, which increases and decreases pressure and temperature within the PTC.

20 Claims, 7 Drawing Sheets

SYSTEM, APPARATUS AND METHOD FOR PULSE TUBE CRYOCOOLER

FIELD

The embodiments generally relate to systems, apparatus and methods for thermal management devices, and more specifically, to pulse tube cryocoolers.

BACKGROUND

Small cryogenic cooling systems are employed in various demanding applications including military and civilian active and remote sensing, superconducting, and general electronics cooling. Such applications often demand efficient, reliable, and cost-effective cooling systems that can achieve extremely cold temperatures below 80 degrees Kelvin.

Efficient cryogenic cooling systems are particularly important in sensing applications involving high-sensitivity infrared focal plane arrays of electromagnetic energy detectors (FPA's). Generally, an FPA may detect electromagnetic energy radiated or reflected from a scene and convert the detected electromagnetic energy into electrical signals corresponding to an image of the scene. To optimize FPA imaging performance, any FPA detector nonuniformities, such as differences in individual detector offsets, gains, or frequency responses, are corrected. Any spatial or temporal variations in temperature across the FPA may cause prohibitive FPA nonuniformities.

FPA's are often employed in avionics applications, particularly missile targeting and satellite applications, where weight, size, and spatial and temporal uniformity of cryogenic cooling systems are important design considerations. An FPA should operate at stable cryogenic temperatures for maximum performance and sensitivity.

Generally, two types of cryocooling systems exist and have been incorporated into FPA's, recuperative cryocoolers and regenerative cryocoolers. In recuperative cryocoolers, a cooling fluid is cycled in a continuous flow. Typical recuperative flow cycles are Brayton or Joule-Thomson processes. Disadvantageously, the cooling fluid typically requires a heavy and bulky FPA cooling interface and heat exchanger, which is attached to the FPA mounting assembly. Consequently, the FPA assembly requires additional mechanical support to secure the interface, heat exchanger, and cooling fluid. The bulky components and additional support hardware oftentimes requires additional cooling, which increases demands placed on the cooling system. In some instances, the bulky support structure, conventionally thought to improve temperature stability, actually reduces system cooling efficiency. Furthermore, the additional bulky mechanical FPA support hardware may cause alignment problems with an on board optical or infrared system during installation and operation, thereby increasing installation and operating costs.

In contrast to recuperative cryocoolers, regenerative cryocoolers have increasingly been employed. Typical regenerative cryocoolers include the Stirling, Gifford-McMahon and pulse tube types, all of which provide cooling through oscillating pressures and masses flows (e.g., the alternating compression and expansion of a working fluid), with a consequent reduction of its temperature. Conventional Stirling and Gifford-McMahon regenerative cryocoolers use displacers to move a working fluid (usually helium or another ideal gas) through their respective regenerators. The noise and vibration induced by the displacer creates problems, and the wear of the seals on the displacer requires periodic maintenance and replacement. Further, the displacer undesirably contributes to axial heat conduction and shuttles heat loss.

Therefore, it may be desirable for cryocooler devices to generate less vibration and less acoustic noise. It may also be desirable to decrease the number of moving parts used in cryocooler devices and to significantly increase the required maintenance intervals and reliability. Pulse tube cryocoolers are a known alternative to the Stirling and Gifford-McMahon cryocooler types; differing from them by the elimination of the mechanical displacer.

A pulse tube is essentially an adiabatic space wherein the temperature of the working fluid is stratified, such that one end of the tube is warmer than the other. A pulse tube cryocooler typically includes a regenerator comprised of a metallic alloy mesh, balls, granules, or shots and a pulse tube, the regenerator and pulse being connected via a cold heat exchanger. Conventional pulse tube cryocoolers operate by cyclically compressing and expanding a working fluid in conjunction with its movement through heat exchangers. Heat is removed from the system upon the expansion of the working fluid in the gas phase. Pulse tube cryocoolers can be divided into two types based on their drivers. The first type is usually referred to as "Stirling-type", because this type employs a linear compressor with a piston or a plunger to linearly move the working gas, just as conventional Stirling cryocoolers usually do. In these Stirling-type pulse tube cryocoolers, the frequency of the compressors is identical with the oscillation frequency of the working fluid in the tube. Stirling pulse tube cryocoolers are usually operated at frequencies above 30 Hz.

At temperatures below 10 K, pulse tube cryocoolers typically work with frequencies as low as 1 to 2 Hz. For avionic applications pulse tube cryocoolers typically operate at 35K and have been used as low as 4.5K with cooling usually less than 0.1 W. In order to keep the volume of the compressor small, it is advantageous to decouple the compressor from the pulse tube such that both systems can be optimized independently of each other. The compressor can then be operated at a higher frequency of e.g. 50 Hz to provide a constant high and low pressure region. The compressor then utilizes a valve system that alternately connects the hot side of the regenerator with low and high pressure. The frequency of valve switching can be adjusted to the desired operation frequency of the pulse tube cryocooler and can be chosen to be much smaller than the frequency of the compressor. Since this valve switching is similar to the construction of the above mentioned Gifford-McMahon-refrigerater (G-M-refrigerator), pulse tube cryocoolers with such valve compressors are usually called G-M-pulse tube cryocoolers.

Stirling-type pulse tube cryocoolers, which mainly aim at miniaturization, reliability, long life and high efficiency, are gradually replacing Stirling cryocoolers, especially in military and space fields (such as infrared sensors for missile guidance, satellite based surveillance, atmospheric studies of ozone hole and greenhouse effects). However, it remains desirable to provide improved cryocoolers of this type which decrease the overall cost of manufacture without sacrificing the reliability, life and efficiency of the system.

SUMMARY

The embodiments are designed to overcome the noted shortcomings associated with conventional systems, apparatus, and methods. In example embodiments, a glass substrate having a substantially plate or flat wafer shape is provided and configured to form a pulse tube cryocooler (hereinafter "PTC") having one or multiple stages. Advantageously, the embodiments, as designed, provide a low cost, long life, reliable and efficient PTC. Further, the PTC of the example embodiments, may generate less vibration and less acoustic noise than conventional cryocoolers.

Example embodiments provide a PTC comprised of an etched glass substrate bonded to a glass plate or wafer and defining one or multiple stages. The etched glass substrate includes a plurality of channels etched into a surface thereof to define a first heat exchanger, a pulse tube, a cold heat exchanger or cold head, a regenerator and a second heat exchanger or aftercooler. The pulse tube is disposed between the cold head and the first heat exchanger and is operable for receiving a fluid which has a temperature above ambient. In example embodiments, the first heat exchanger is connected to a valve or inertance tube which, in turn, is connected to a buffer tank or reservoir. The regenerator is disposed between the cold head and the aftercooler, the aftercooler being connected to an external compressor. The bonding of the etched glass substrate to the glass plate or wafer encloses the etched channels to form capillaries operable for conducting and distributing fluid.

In an example embodiment, a PTC is provided that is manufactured by the method of providing and etching a surface of a glass substrate with a plurality of channels to form a first heat exchanger region, a pulse tube region, a cold head region, a regenerator region and a second heat exchanger or aftercooler region. Once the glass substrate is etched with the desired number of channels a blank glass plate or wafer is bonded thereon for hermetic sealing (i.e., to enclose the channels thereby forming capillaries for conducting and distributing a gas or fluid). Thereafter, an inlet port is made through a defined location at the first heat exchanger region for connection to an inertance tube. An outlet port is made through a defined location at the aftercooler region for connection to a compressor.

In an example embodiment, an operation of the PTC includes having a gas or fluid enter through an inlet port and through the pulse tube. The PTC is configured to insulate the heat exchange process at its respective ends. That is, the heat exchanger is configured to be large enough such that gas/fluid flowing from the inlet port traverses through the first heat exchanger and only part way through the pulse tube before flow is reversed. Likewise, fluid flow from the compressor side traverses through the aftercooler and only part way through the regenerator before flow is reversed. Gas/fluid in the middle portion of the PTC (i.e., the cold head) is sealed in, remains in the PTC during operation, and forms a temperature gradient that insulates the two ends of the PTC. Roughly speaking, the gas/fluid in the PTC is divided into three segments, with the cold head portion acting as a displacer but consisting of gas as opposed to a solid materials. Functionally, the PTC transmits hydrodynamic or acoustic power in the oscillating gas cryo-system from one end to the other across a temperature gradient with a minimum power dissipation and entropy generation.

In other example embodiments, a folded or manifold configuration may be provided. In such configurations, two glass substrates are etched and bonded such that one substrate forms a pulse tube layer and the other forms a regenerator layer. The two layers are then bonded together in a stacked form with a third blank layer disposed between the two, warm at one end and cold at the other. Each layer is provided with a plurality of through holes or fluid flow passages such that fluid can translate from layer to the other. In such configurations, the warm end may be provided with a first connection from the compressor and into the regenerator and a second connection from the inertance tube and into the pulse tube.

In other example embodiments, a multiple stage PTC is provided. In such configurations, multiple glass substrates are etched and bonded such that one substrate forms a pulse tube layer having at least one pulse located thereon and the other forms a regenerator layer having at least one regenerator located thereon. The layers are then bonded together in a stacked form, with the combination and stacking varying depending on the intended use and geometric boundaries. Each layer is provided with a plurality of through holes or passageways such that fluid can translate from one layer to the other. In such configurations, a first connection from the compressor and into the regenerator and a second connection from the inertance tube and into the pulse tube is provided. In example embodiments, a second inertance tube connection is provided. Advantageously, cryocooler capacity can be increased by adding additional identical layers.

Additional features and advantages of the disclosure will be set forth in the detailed description which follows, and in part will be readily apparent to those skilled in the art from that description or recognized by practicing the disclosure as described herein, including the detailed description which follows, the claims, as well as the appended drawings.

It is to be understood that both the foregoing general description and the following detailed description present example embodiments of the disclosure, and are intended to provide an overview or framework for understanding the nature and character of the disclosure as it is claimed. The accompanying drawings are included to provide a further understanding of the disclosure, and are incorporated into and constitute a part of this specification. The drawings illustrate various embodiments of the disclosure, and together with the detailed description, serve to explain the principles and operations thereof.

BRIEF DESCRIPTION OF THE DRAWINGS

The embodiments may take form in various components and arrangements of components, and in various steps and arrangements of steps. The appended drawings are only for purposes of illustrating example embodiments and are not to be construed as limiting the subject matter.

DETAILED DESCRIPTION

The embodiments will now be described more fully hereinafter with reference to the accompanying drawings in which example embodiments are shown. However, this disclosure may be embodied in many different forms and should not be construed as limited to the embodiments set forth herein. These example embodiments are provided so that this disclosure will be both thorough and complete, and will fully convey the scope of the disclosure to those skilled in the art. Like reference numbers refer to like elements throughout the various drawings. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The embodiments are designed, provide a low cost, reliable, long-life, and efficient pulse tube cryocooler (hereinafter "PTC") operable for use with military and civilian active and remote sensing, superconducting, and general electronics cooling applications. Example embodiments presented herein disclose systems, apparatus and methods for a glass slide pulse tube cryocooler operable for use with avionics applications, and more particularly, missile targeting and satellite applications, where weight, size, and spatial and temporal uniformity of cryogenic cooling systems are important design considerations. Advantageously, the PTCs provided herein may be used for cooling an infrared (IR) focal plane array (FPA) disposed in an integrated detector cooler assembly (IDCA).

Figure 1:
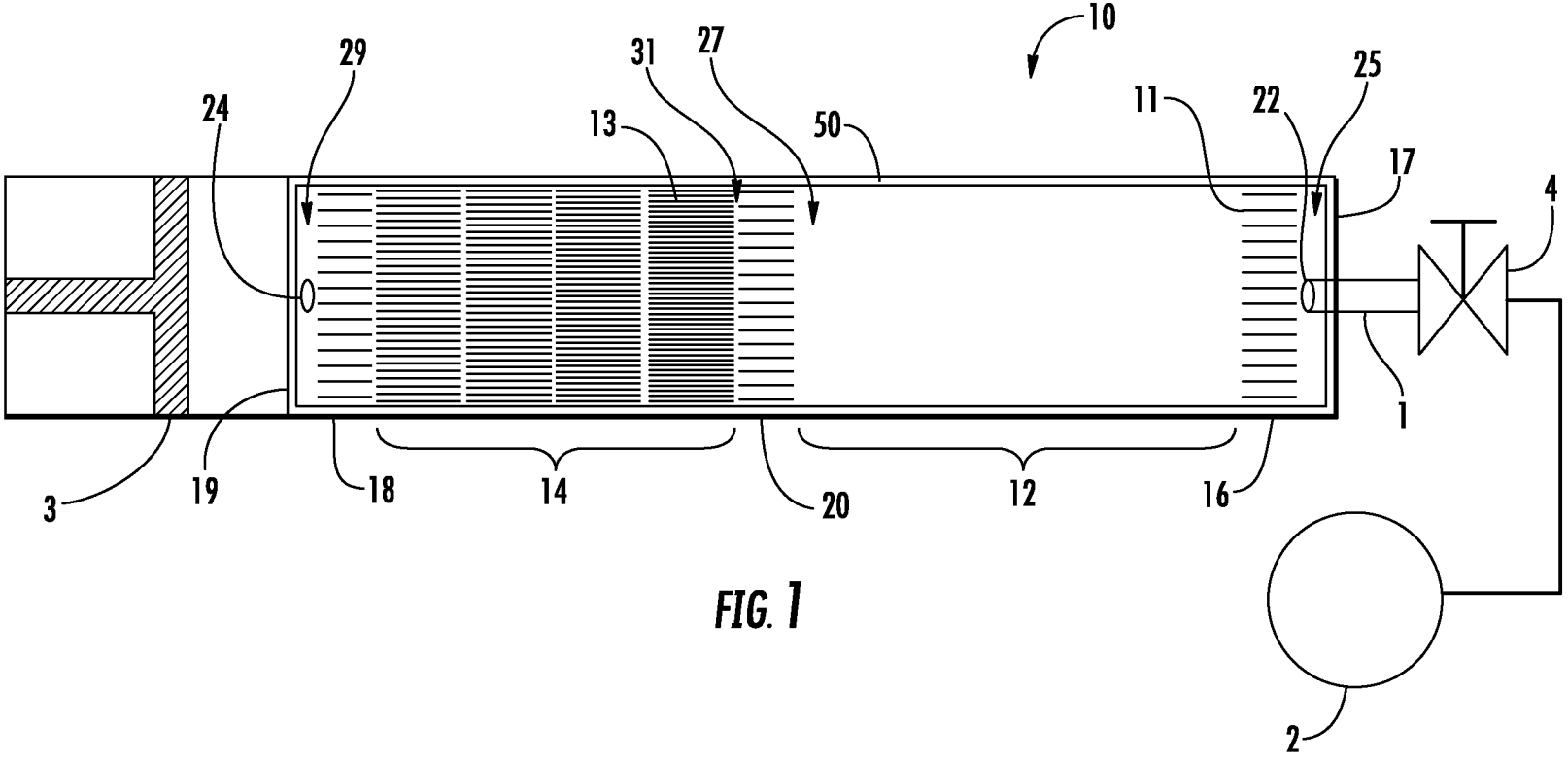
FIG. 1 is a schematic diagram of a Stirling-type glass slide pulse tube cryocooler system in accordance with an embodiment.
Figure 2A:
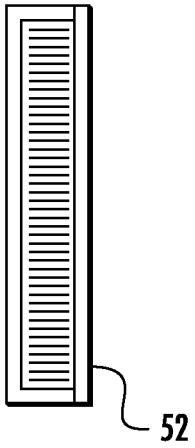
FIG. 2A is a schematic, cross-sectional diagram of a Stirling-type glass slide pulse tube cryocooler in accordance with exemplary embodiments.
Figure 2B:
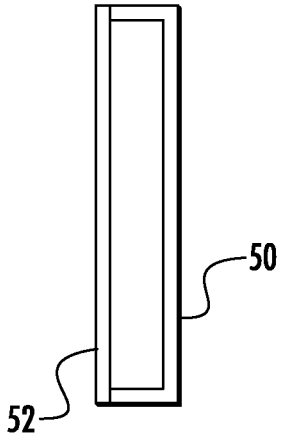
FIG. 2B is a schematic, cross-sectional diagram of a Stirling-type glass slide pulse tube cryocooler in accordance with exemplary embodiments.

Referring now to the FIGS. 1, 2A, and 2B, an "in-line" or Stirling-type, glass slide PTC system and apparatus constructed in accordance with an example embodiment is shown. As illustrated, a PTC 10 is provided and comprises a glass substrate 50 having first and second ends, 17, 19, respectively, the glass substrate 50 being bonded to a glass plate or wafer 52 and defining one or multiple stages. The glass substrate 50 includes a plurality of channels 11, 13 etched into a surface thereof, said plurality of channels 11, 13 to defining a first heat exchanger 16, a pulse tube 12 having a hot end 25 and a cold end 27 (the hot and cold ends being characterized by a temperature above or below ambient), a cold heat exchanger or cold head 20, a regenerator 14 having a hot end 29 and a cold end 31 (the hot and cold ends being characterized by a temperature above or below ambient) and a second heat exchanger or aftercooler 18. In example embodiments, the pulse tube 12 is positioned between the first heat exchanger 16 and the cold head 20 and is operable for receiving a fluid which has a temperature above ambient. As used herein, the term "fluid" means a super set of the phases of matter and includes liquids, gases, and plasmas. The regenerator 14 is positioned between the cold head 20 and the aftercooler 18.

In example embodiments, the glass substrate 50 may be a silica glass material, such as fused silica glass, soda-lime-glass, Sodium borosilicate glass, Pyrex, crystal glass, or Oxide glass. Further, in example embodiments, the glass substrate 50 may be a solid that possesses a non-crystalline (i.e. amorphous) structure and that exhibits a glass transition when heated towards the liquid state. Further, in example embodiments, the glass substrate 50 may be composed of ionic melts, aqueous solutions, molecular liquids, and polymers. Still further, in example embodiments, a polymeric glass substrate may be used such as, for example, acrylic glass, polycarbonate, polyethylene terephthalate.

In example embodiments, disposed at the hot end 25 of the pulse tube 12 is an inlet port 22 for receiving a valve connection or an inertance tube 1. In example embodiments, the inertance tube 1 is connected or connectable via an orifice 4 to a buffer or reservoir 2 configured for maintaining a fluid. In example embodiments, the hot end 29 nearest the aftercooler 18 is provided with an outlet port 24 and is connected or connectable to a compressor or moveable piston 3. The bonding of the etched glass substrate 50 to the glass plate or wafer 52 encloses the etched channels 11, 13 to form capillaries operable for conducting and distributing fluid. In example embodiments, the fluid may be helium, nitrogen, argon, methane, ethane, or other gas components, or mixtures thereof.

In example embodiments, the heat exchanger channels 11 are approximately 50 to 100 microns wide and 0.5-2 mm deep. In other example embodiments, the regenerator channels 13 are 15-30 microns wide and 0.5-2 mm deep. In still other example embodiments, the pulse tube 12 is approximately 1-4 mm deep. In still other example embodiments, the spacing between the heat exchanger and regenerator channels is equal to the respective channel width.

In example embodiments, an operation of the PTC 10 includes having a fluid first enter the PTC 10 through the inlet port 22 and through the pulse tube 12. The compressor 3 moves periodically back and forth or from left to right and back to generate high and low pressures. More specifically, as a result of the movement of the compressor 3, the fluid moves from left to right and back while the pressure within the PTC 10 increases and decreases. As the pressure increases, the fluid is compressed thereby increasing the temperature to above the ambient temperature. Conversely, as the pressure decreases, the fluid expands and the temperature decreases. If the fluid is compressed it enters the regenerator 14 with an elevated temperature and leaves the regenerator 14 at the cold head 20 with decreased temperature, hence heat is transferred into the regenerator 14. On its return, the heat stored within the regenerator 14 is transferred back into the fluid. The thermal environment of a fluid near the cold head 20, that moves back and forth in the PTC 10, changes when it passes through the aftercooler 18. In the regenerator 14 and in the aftercooler 18 the heat contact between the fluid and its surrounding material is optimal for the desired operation. The temperature of the fluid is substantially the same as of the surrounding medium. However, in the pulse tube 12 the fluid is thermally isolated (adiabatic), so, in the pulse tube 12, the temperature of the fluid vary with the pressure.

Stated another way, the PTC 10 is configured to insulate the heat exchange process at it two ends 17, 19. The PTC 10 is sized to be larger enough so that fluid flowing from the inlet port 22 traverses through the first heat exchanger 16 and only part way through the pulse tube 12 before flow is reversed. Likewise, fluid flow from the compressor 3 traverses through the aftercooler 18 and only part way through the regenerator 14 before flow is reversed. In the illustrated configuration, gas/fluid in the middle portion of the PTC 10 (i.e., the cold head 20) is sealed in by the competing flows from the pulse tube 12 and the regenerator 14 and remains in the cold head 20 region during operation. Advantageously, the result is that a temperature gradient is formed which insulates the PTC 10 at its two ends 17, 19. The fluid in the PTC 10 is divided into three segments, with the cold head 20 acting as a displacer but consisting of fluid as opposed to a solid materials. Advantageously, the overall function of the PTC 10 is that is transmits hydrodynamic or acoustic power in the oscillating fluid cryosystem from one end to the other across a temperature gradient with a minimum power dissipation and entropy generation.

Figure 4:
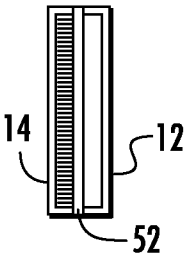
FIG. 4 is a schematic, cross-sectional diagram of a manifold-type, glass slide pulse tube cryocooler in accordance with exemplary embodiments.
Figure 3:
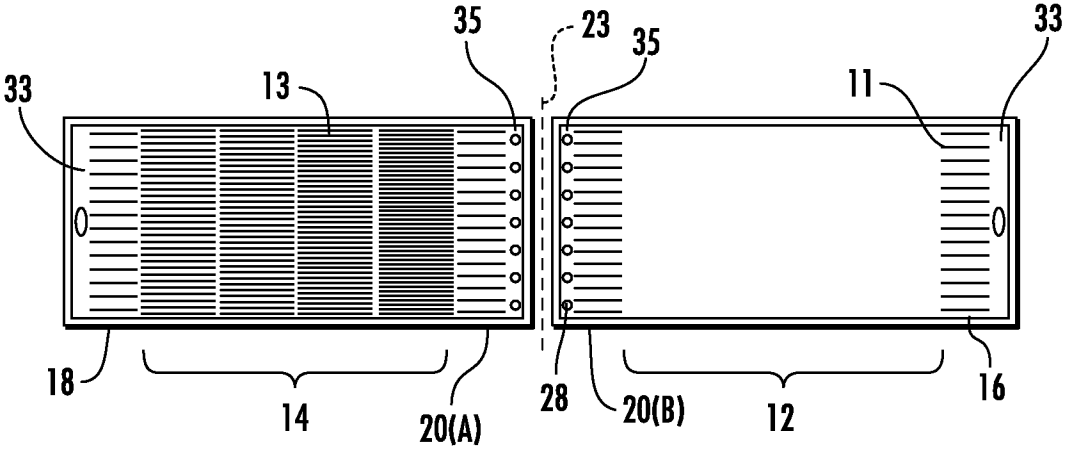
FIG. 3 is a schematic diagram of a manifold-type, glass slide pulse tube cryocooler in accordance with an embodiment.

Referring now to FIGS. 3-4, an example embodiment of a folded or manifold configuration PTC 10 is illustrated. In example embodiments, the PTC 10 is manufactured in the same manner as described herein for FIGS. 1, 2A and 2B. Additionally, through holes 28 are partially bored into the glass substrate 50 at a "fold line" 23. The fold line 23 being defined as an approximate center of the cold heat exchanger 20. The glass substrate 50 is separated into two pieces at the fold line 23 to form two cold heat exchangers, 20A and 20B. and they are then bonded together in a folded or manifold configuration such that the through holes 28 mate or correspond with each other to permit fluid flow between layers. Alternatively, two glass substrates are etched and bonded such that one substrate forms a pulse tube layer 12 and the other forms a regenerator layer 14. The two layers are then bonded together in a folded or stacked configuration, with a defined warm end 33 and cold end 35. In example embodiments, each layer is provided with through holes or fluid flow passages 28 such that fluid can translate from layer to the other. In example embodiments, the warm end 33 may be provided with a first connection from the compressor and into the regenerator 14 and a second connection from the inertance tube and into the pulse tube 12. In example embodiments, a glass spacer 52 having through holes 28 bored through is provided. In such a configuration, the two layers do not have any through holes 28 and are bonded together with the glass spacer 52 interposed between them, the through holes 28 of the glass spacer 52 permitting fluid flow from one layer to the other.

Figure 6:
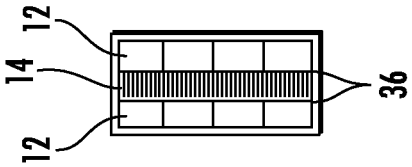
FIG. 6 is a schematic, cross-sectional diagram of a multi-stage, stacked, glass slide pulse tube cryocooler in accordance with an embodiment.
Figure 5:
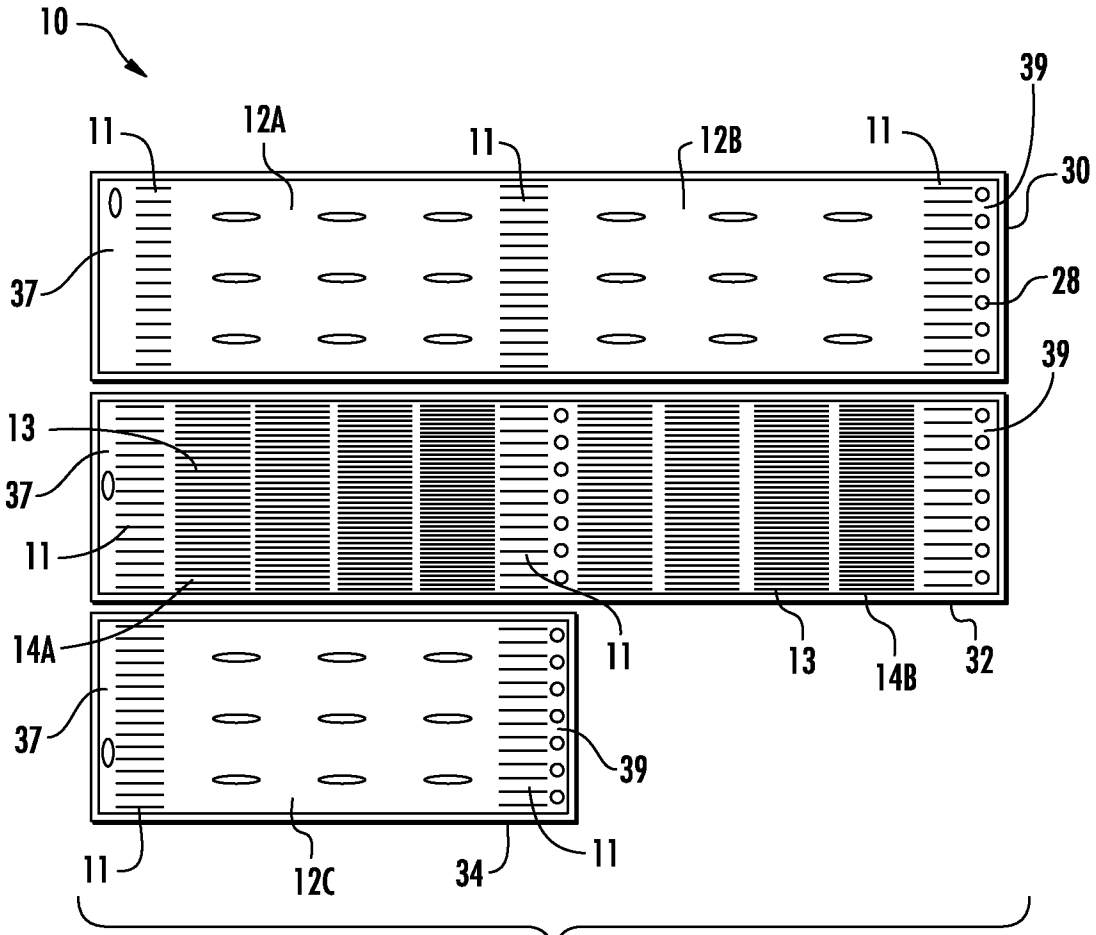
FIG. 5 is a schematic diagram of a multi-stage, stacked, glass slide pulse tube cryocooler in accordance with an embodiment.

Referring now to FIGS. 5-6, an example embodiment of a two staged, stacked, PTC 10 is illustrated. As shown, multiple glass slides 30, 32, 34 are provided and etched with a plurality of channels 11, 13. In the example shown, one glass slide is etched with two regenerators 14A and 14B, one glass slide is etched with two pulse tubes 12A and 12B and one glass slide is etched with a single pulse tube 12C. Through holes 28 are partially bored into the glass slides 30, 32, 34 at defined connection points. Thereafter, blank glass plates or wafers 36 having corresponding through holes 28 are bonded to the glass slides 30, 32, 34 and then they, in turn, are bonded together in a stacked configuration such that the through holes 28 mate or correspond with each other to permit the fluid flow between layers, the stacked configuration defining a warm end 37 and cold end 39. In example embodiments, the warm end 37 may be provided with a first connection from the compressor and into the regenerator 14A and a second and third connection from the inertance tube and into the pulse tubes 12A, 12B, and 12C. It will be appreciated that while the illustrated process discloses a two-stage PTC 10, more complicated cryocoolers may be manufactured by adding additional identical layers. Further, multiple cold heads with geometric variations may be manufactured.

Figure 7:
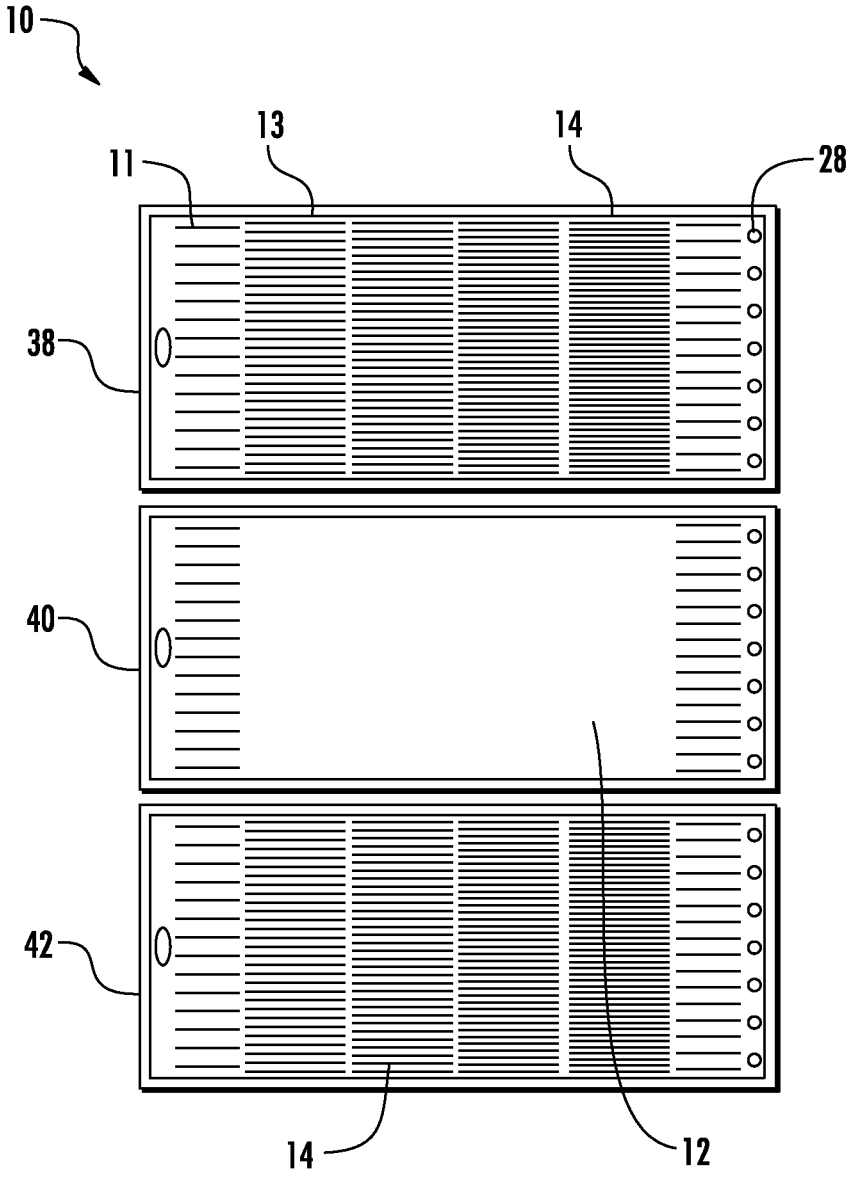
FIG. 7 is a schematic diagram of a high capacity, glass pulse tube cryocooler in accordance with an embodiment.
Figure 8A:
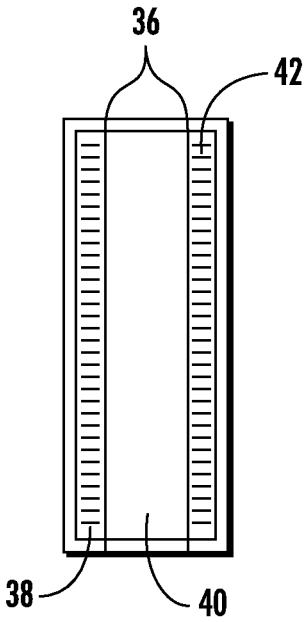
FIG. 8A is a schematic, cross-sectional diagram of a high capacity, glass pulse tube cryocooler in accordance with an embodiment.
Figure 8B:
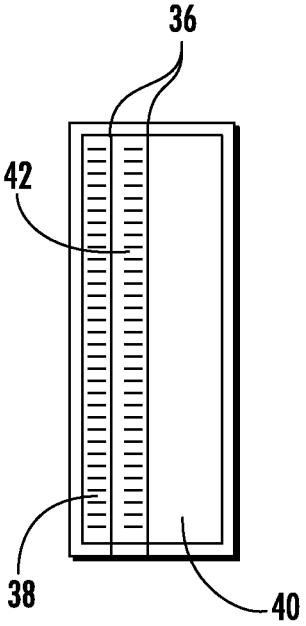
FIG. 8B is a schematic, cross-sectional diagram of a high capacity, glass pulse tube cryocooler in accordance with an embodiment.

Referring now to FIGS. 7-8, an example embodiment of a high capacity, stacked, PTC 10 is illustrated. As shown, multiple glass slides 38, 40, 42 are provided and etched with a plurality of channels 11, 13. In the example shown, each glass slide 38, 40, 42 is etched with either a regenerator 14 or a pulse tube 12, the combinations of which may vary depending on the specific heat exchange application. Thereafter, blank glass wafers 36 having through holes 28 bored there through are bonded to the glass slides 38, 40, 42 at defined connection points. Then, the layers 38, 40, 42 are bonded together in a stacked configuration (the configurations varying depending on the specific heat exchange application, FIGS. 8*a* and 8B) such that the through holes 28 mate or correspond with each other to permit the fluid flow between layers.

In example embodiments, the PTC 10 may be used for cooling and maintaining at an operating temperature an infrared (IR) focal plane array (FPA) (not shown) disposed in an integrated detector cooler assembly (IDCA) (not shown). In such example embodiments, cooling the FPA to a desired operating temperature may be performed by providing a glass slide pulse tube cryocooler that is connected or connectable to the FPA. The glass tube cryocooler may include first and second ends and a plurality of channels etched into a surface between said ends. The plurality of channels are configured to define a heat exchanger positioned at the first end, an aftercooler positioned at the second end, a cold head disposed between the heat exchanger and the aftercooler, a pulse tube disposed between and in fluid communication with the heat exchanger and the cold head, and a regenerator disposed between and in fluid communication with the cold head and the aftercooler. In such example embodiments, the etched surface of the glass substrate is bonded with a glass plate to enclose the plurality of channels to form capillaries for conducting and distributing a fluid. Further, the regenerator is connected or connectable with an oscillating compressor which compresses or permits expansion of the fluid such that a temperature gradient is formed at the cold head to insulate the first and second ends and maintain the FPA at the desired operating temperature. In example embodiments, the use of the PTC permits cooling of the FPA within 5 to 10 seconds.

Figure 9:
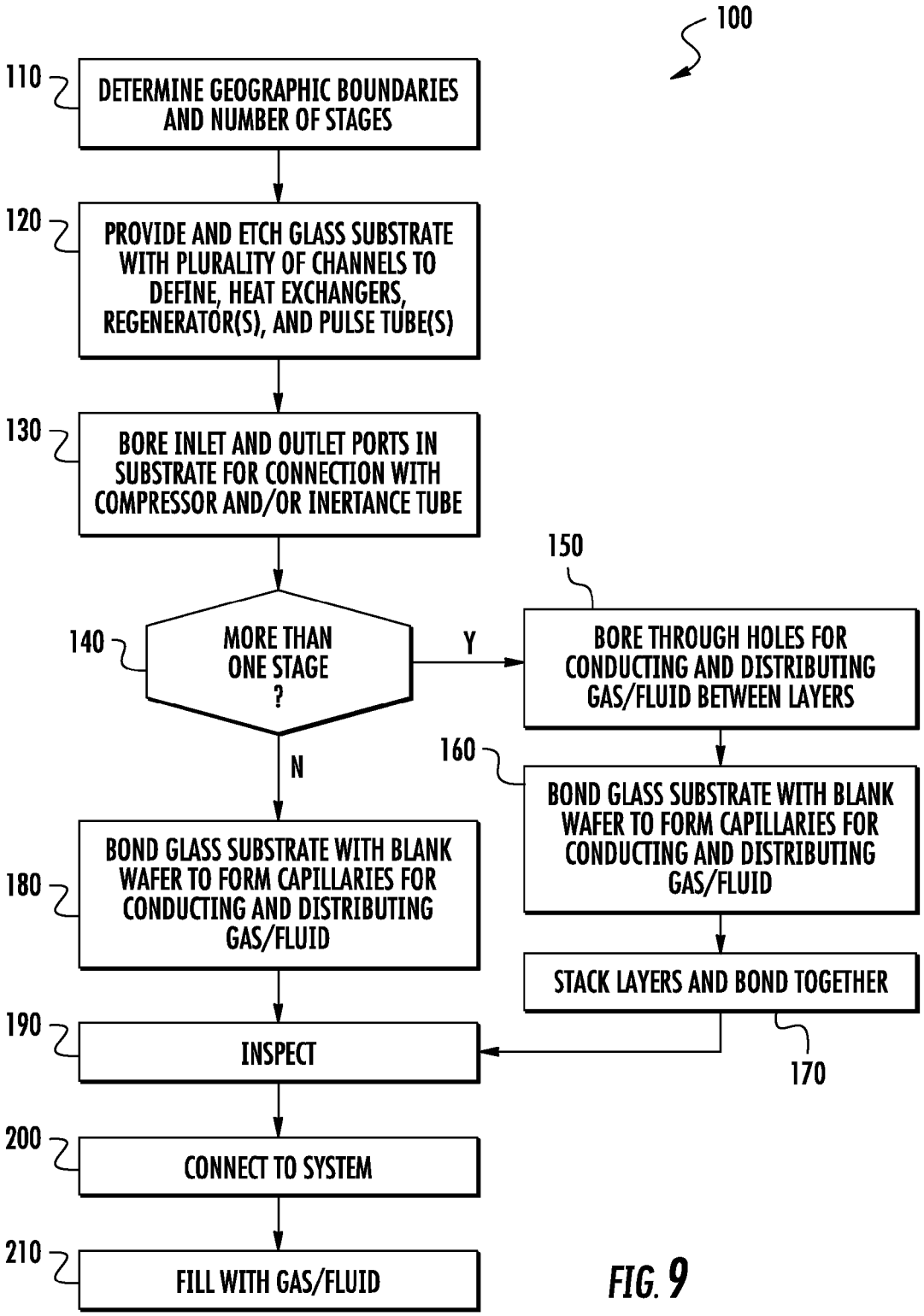
FIG. 9 is an illustrative step in the fabrication process used to implement one or more example embodiments of a glass slide pulse tube cryocooler.

Referring now to FIG. 9, a method of fabrication 100 of the PTC 10 is provided. As shown, the method of fabrication 100 begins with a determination of the geometric boundaries and the number of stages of a desired PTC 10 for incorporation into a specific application such as a FPA disposed in IDCA (Step 110). The predetermined number of stages and the geometric boundaries—length, and/or diameter may be varied to meet the heat exchange application. At Step 120, a glass slide substrate 50 is provided and etched such that a plurality of channels 11, 13 are formed in the surface of the glass substrate 50. In example embodiments, the etching process is performed by reactive-ion etching (RIE) or deep reactive-ion etching (DRIE). However, it will be appreciated that any suitable method of etching may be employed. As etched, the glass substrate 50 may include various regions including, a first heat exchanger 16, a pulse tube 12, a cold head 20, a regenerator 14 and an aftercooler 18.

At step 130, the glass substrate 50 may have inlet and outlet ports 22, 24 bored therein. The inlet port 22 may be in fluid communication with an inertajnce tube, said inlet port 22 being operable for conducting and distributing a fluid from a inertance tube to the pulse tube 12. The outlet port 24 may be in fluid communication with a compressor, said outlet port 24 being operable for conducting and distributing a fluid from the aftercooler 18 to the compressor.

At step 140, a determination is made as to whether more than one stage or layers are required for the application. If more than one stage/layer is required, then through holes or fluid flow passages 28 are bored into a glass plate 52 along defined locations at the distal ends (Step 150). Thereafter, at Step 160, the glass substrate 50 is bonded with the glass plate 52 such that the plurality of channels 11, 13 are enclosed and hermetically sealed, thereby forming capillaries. In example embodiments, the glass substrate 50 may have partially, prebored through holes 28 which correspond to those bored into the glass plate 52. Alternatively, the glass plate 52 may first be bonded to the glass substrate 50 and then have the through holes 28 bored, it being understood that the through holes 28 are operable for connecting, conducting and distributing a fluid in a stacked, multi-stage configuration. At Step 170, the layers are bonded together such that the through holes 28 permit the flow of fluid from one to another. If a multi-stage, stacked PTC 10 is to be manufactured, the pulse tube layer(s) and regenerator layer(s) are bonded to together in a folded or manifold type configuration.

If, however, only one stage or layer is required, then the glass substrate 50 is bonded with a glass plate 52 such that the plurality of channels 11, 13 are enclosed and hermetically sealed, thereby forming capillaries (Step 180).

In example embodiments, the glass plate 52 is bonded to the etched glass substrate 50 by using glass frit material to coat bond surfaces and then heating the glass to the softening point such that the frit material melts and makes a hermetic seal. In other example embodiments, a KOH/NaOH solution may be used to bond the glass plate 52 to the etched glass substrate 50.

At Step 190, the bonded PTC 10 is inspected for both fidelity and precision. Thereafter, the PTC 10 is incorporated into and connected to the specified application (Step 200), such as an IDCA, and the PTC 10 is then filled with a fluid having the desired physical properties (Step 210).

Advantageously, the disclosed systems, apparatus and methods for a glass slide PTC offers low-cost manufacturing with precision control over the generation of the capillary passages which can be tailored to specific cooling requirements, and offers the capability to incorporate high-performance materials such as carbon fibers for excellent thermal characteristics.

The embodiments described above provide advantages over conventional devices and associated systems and methods. It will be apparent to those skilled in the art that various modifications and variations can be made to the embodiments without departing from the spirit and scope of the disclosure. Thus, it is intended that the disclosure cover the modifications and variations of this disclosure provided they come within the scope of the appended claims and their equivalents. Furthermore, the foregoing description of the embodiments and best mode for practicing the disclosure are provided for the purpose of illustration only and not for the purpose of limitation—the disclosure being defined by the claims.

What is claimed is:

1. A pulse tube cryocooler comprising:

a glass substrate having first and second ends, an etching surface, and a plurality of channels etched into the etching surface, said plurality of channels defining a heat exchanger positioned at the first end, an aftercooler positioned at the second end, a cold head disposed between the heat exchanger and the aftercooler, a pulse tube disposed between and in fluid communication with the heat exchanger and the cold head, and a regenerator disposed between and in fluid communication with the cold head and the aftercooler;

wherein the etched surface of the glass substrate is bonded with a glass plate to enclose the plurality of channels to form capillaries for conducting and distributing a fluid; and wherein the regenerator is connected or connectable with an oscillating compressor which compresses or permits expansion of the fluid such that a temperature gradient is formed at the cold head to insulate the first and second ends.

2. The pulse tube cryocooler of claim 1, further comprising an inlet port disposed in the pulse tube for connection and fluid communication with an inertance tube that is connected with a reservoir containing fluid.

3. The pulse tube cryocooler of claim 1, further comprising an outlet port disposed in the regenerator for connection and fluid communication with the compressor.

4. The pulse tube cryocooler of claim 1, wherein the glass substrate is comprised of a silica glass material.

5. The pulse tube cryocooler of claim 4, wherein the silica glass is selected from the group consisting of fused silica glass, soda-lime-glass, Sodium borosilicate glass, Pyrex, crystal glass, and Oxide glass.

6. The pulse tube cryocooler of claim 1, wherein the heat exchanger includes channels having a width in the range of 50 to 100 microns and a depth in the range of 0.5-2 mm.

7. The pulse tube cryocooler of claim 1, wherein the regenerator includes channels having a width in the range of 15-30 microns wide and a depth I the range of 0.5-2 mm.

8. The pulse tube cryocooler of claim 1, wherein the pulse tube is has a depth in the range of 1-4 mm.

9. The pulse tube cryocooler of claim 1, further comprising a plurality of passages bored into the distal ends of the bonded glass plate and glass substrate, and wherein the bonded glass substrate and glass plate are separated at a fold line located at an approximate center of the cold head to form two layers; and wherein the layers are bonded together in a folded configuration such that the through holes mate with one another to permit fluid flow between layers.

10. The pulse tube cryocooler of claim 1, wherein the glass substrate comprises two or more glass slides having first and second ends;

wherein each of the two or more glass slides is etched with a plurality of channels for defining at least one pulse tube or at least one regenerator and having a plurality of through holes bored into the first end; and wherein the two or more glass slides are bonded together in a layered configuration such that the through holes mate with one another to permit fluid flow between layers.

11. A pulse tube cryocooler, comprising:

a glass substrate having a plurality of channels etched into a first surface, said plurality of channels defining at least one regenerator having a hot end and a cold end, at least one pulse tube having a hot end and a cold heat exchanger;

wherein a first heat exchanger is disposed at the hot end of the regenerator and a second heat exchanger is disposed at the hot end of the pulse tube; and wherein a cold heat exchanger is disposed between and in fluid communication with the regenerator and the pulse tube.

12. The pulse tube cryocooler of claim 11, wherein an inlet port is disposed at the hot end of the pulse tube for receiving an inertance tube, said inertance tube being connected to a buffer or reservoir configured to maintain a fluid.

13. The pulse tube cryocooler of claim 11, wherein the second heat exchanger is provided with an outlet port, said outlet port being connected to a compressor.

14. The pulse tube cryocooler of claim 11, wherein the glass substrate is comprised of a silica glass material.

15. The pulse tube cryocooler of claim 14, wherein the silica glass is selected from the group consisting of fused silica glass, soda-lime-glass, Sodium borosilicate glass, Pyrex, crystal glass, and Oxide glass.

16. The pulse tube cryocooler of claim 11, wherein the heat exchanger channels are in the range of 50 to 100 microns wide and 0.5-2 mm deep.

17. The pulse tube cryocooler of claim 11, wherein the regenerator channels are in the range of 15-30 microns wide and 0.5-2 mm deep.

18. The pulse tube cryocooler of claim 11, wherein the pulse tube is in the range of 1-4 mm deep.

19. The pulse tube cryocooler of claim 11, further comprising a glass spacer having a plurality of through holes bored into a first end;

wherein the glass substrate comprises two or more glass slides having first and second ends;

wherein each of the two or more glass slides is etched with a plurality of channels for defining at least one pulse tube or at least one regenerator; and wherein the two or more glass slides are bonded together in a layered configuration with the glass spacer interposed between them such that the through holes permit fluid flow between layers.

20. A method of cooling a focal plane array (FPA) disposed in an integrated detector cooler assembly (IDCA) to an operating temperature, the method comprising:

cooling the FPA to a desired operating temperature by providing a glass slide pulse tube cryocooler connected to the FPA, said glass tube cryocooler having first and second ends and a plurality of channels etched into a surface between said ends, the plurality of channels defining a heat exchanger positioned at the first end, an aftercooler positioned at the second end, a cold head disposed between the heat exchanger and the aftercooler, a pulse tube disposed between and in fluid communication with the heat exchanger and the cold head, and a regenerator disposed between and in fluid communication with the cold head and the aftercooler;

wherein the etched surface of the glass substrate is bonded with a glass plate to enclose the plurality of channels to form capillaries for conducting and distributing a fluid; and wherein the regenerator is connected or connectable with an oscillating compressor which compresses or permits expansion of the fluid such that a temperature gradient is formed at the cold head to insulate the first and second ends and maintain the FPA at the desired operating temperature.

* * * * *

UNITED STATES PATENT AND TRADEMARK OFFICE

CERTIFICATE OF CORRECTION

PATENT NO. : 9,175,884 B2
APPLICATION NO. : 13/938529
DATED : November 3, 2015
INVENTOR(S) : Olson It is certified that error appears in the above-identified patent and that said Letters Patent is hereby corrected as shown below:

Title Page, Item (72) Inventor is corrected to read:
-- Jeffrey R. Olson, San Mateo (CA) --.

Signed and Sealed this
Thirty-first Day of May, 2016

Michelle K. Lee

Michelle K. Lee
*Director of the United States Patent and Trademark Office*